US007569133B2

(12) United States Patent
Körtvelyessy et al.

(10) Patent No.: US 7,569,133 B2
(45) Date of Patent: Aug. 4, 2009

(54) DEVICE AND METHOD FOR REMOVING SURFACE AREAS OF A COMPONENT

(75) Inventors: Daniel Körtvelyessy, Berlin (DE); Ralph Reiche, Berlin (DE); Jan Steinbach, Berlin (DE); Marc de Vogelaere, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 437 days.

(21) Appl. No.: 10/511,251

(22) PCT Filed: Mar. 12, 2003

(86) PCT No.: PCT/DE03/00953

§ 371 (c)(1),
(2), (4) Date: May 10, 2005

(87) PCT Pub. No.: WO03/085174

PCT Pub. Date: Oct. 16, 2003

(65) Prior Publication Data

US 2005/0224367 A1 Oct. 13, 2005

(30) Foreign Application Priority Data

Apr. 8, 2002 (DE) ..... 102 15 374
Dec. 18, 2002 (DE) ..... 102 59 365

(51) Int. Cl.
*C25F 5/00* (2006.01)

(52) U.S. Cl. ..... 205/646

(58) Field of Classification Search ..... 205/103, 205/107, 717, 646
See application file for complete search history.

(56) References Cited

U.S. PATENT DOCUMENTS

| | | | | | |
|---|---|---|---|---|---|
| 2,744,860 | A | * | 5/1956 | Rines | 205/137 |
| 3,519,543 | A | | 7/1970 | Gwyn | |
| 3,616,346 | A | * | 10/1971 | Inoue | 205/642 |
| 4,004,992 | A | * | 1/1977 | Tyler et al. | 205/649 |
| 4,174,261 | A | | 11/1979 | Pellegrino | |
| 4,466,864 | A | | 8/1984 | Bacon et al. | |
| 5,944,909 | A | | 8/1999 | Reeves et al. | |
| 6,056,869 | A | | 5/2000 | Uzoh | |
| 6,165,345 | A | | 12/2000 | Updegrove et al. | |
| 6,315,885 | B1 | * | 11/2001 | Hocheng | 205/652 |
| 6,402,931 | B1 | * | 6/2002 | Zhou et al. | 205/659 |
| 6,599,416 | B2 | * | 7/2003 | Kool et al. | 205/717 |

FOREIGN PATENT DOCUMENTS

| | | | |
|---|---|---|---|
| DE | 195 47 948 | C1 | 11/1996 |
| EP | 1 010 782 | A1 | 6/2000 |
| EP | 1 094 134 | A1 | 4/2001 |
| EP | 1 122 323 | A1 | 8/2001 |
| GB | 2 030 596 | A | 4/1980 |
| GB | 2 111 530 | A | 7/1983 |

* cited by examiner

*Primary Examiner*—Harry D Wilkins, III

(57) ABSTRACT

Apparatus and process for removing surface regions of a component. The prior art involves removing surface regions of a metallic component by means of electrochemical processes. The electrochemical process is accelerated by the use of a current pulse generator.

11 Claims, 2 Drawing Sheets

DEVICE AND METHOD FOR REMOVING SURFACE AREAS OF A COMPONENT

CROSS REFERENCE TO RELATED APPLICATION

This application is the US National Stage of International Application No. PCT/DE03/00953, filed Mar. 21, 2003 and claims the benefit thereof. The International Application claims the benefits of German application No. 10215374.4 DE filed Apr. 8, 2002, and German application No. 10259365.5 DE filed Dec. 18, 2002, all of the applications are incorporated by reference herein in their entirety.

FIELD OF THE INVENTION

The invention relates to an apparatus and a process for removing surface regions of a component as described in the claims.

BACKGROUND OF THE INVENTION

Hitherto, components which have been coated with coatings of type MCrAlY or $ZrO_2$ have had the coating removed, for example, by acid stripping in combination with sand blasting or by high-pressure water blasting.

EP 1 122 323 A1 and U.S. Pat. No. 5,944,909 show examples of the chemical removal of surface regions.

EP 1 941 34 A1, EP 1 010 782 A1 and U.S. Pat. No. 6,165,345 disclose methods for the electrochemical removal of metallic coatings (stripping).

The processes listed above are time-consuming and therefore expensive.

SUMMARY OF THE INVENTION

It is an object of the invention to provide an apparatus and a process in which the removal of the coating takes place more quickly and economically.

The object is achieved by an apparatus and a process for the removal of surface regions from a component as described in the claims.

Further advantageous configurations and process steps are listed in the corresponding subclaims.

DETAILED DESCRIPTION OF THE INVENTION

Figure 1:
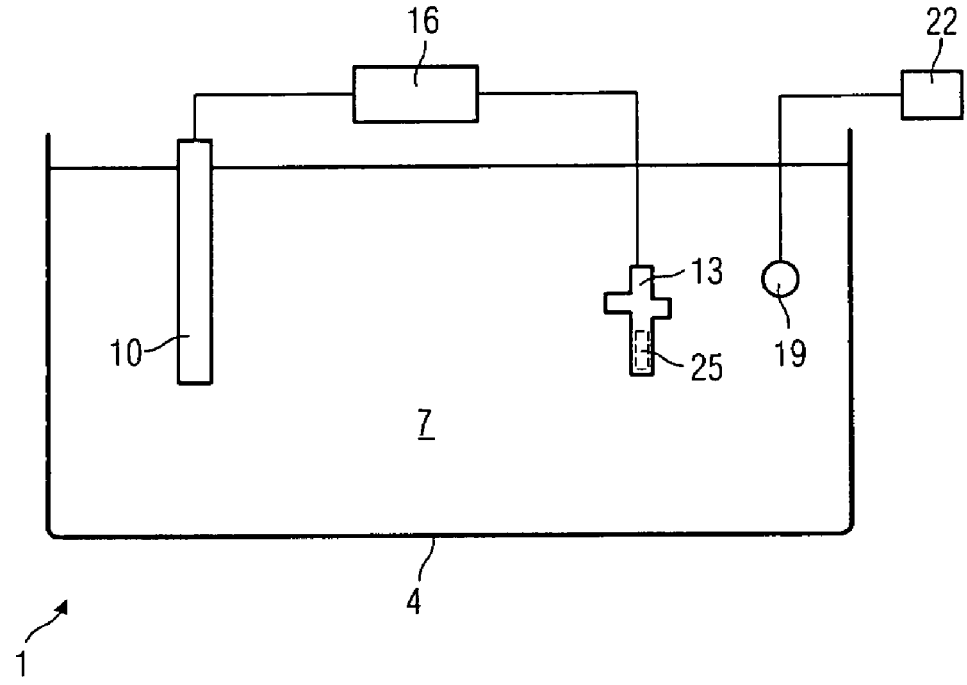
FIG. 1 shows an apparatus according to the invention.

FIG. 1 shows an apparatus 1 according to the invention. The apparatus 1 comprises a vessel 4 in which an electrolyte 7 there is arranged. An electrode 10 and a component 13 are arranged in the electrolyte 7. The electrode 10 and the component 13 are electrically connected to a current/voltage pulse generator 16. The component 13 is, for example, a coated turbine blade or vane, the substrate of which is a nickel- or cobalt-base superalloy, to which a metallic layer has been applied to serve, for example, as a corrosion-resistant or anchoring layer. A layer of this type in particular has the composition MCrAlY, where M stands for an element iron, cobalt or nickel.

The coating has been corroded during use of the turbine blade or vane 13. The surface region 25 which has been formed as a result (as indicated by dashed lines) is to be removed by the process according to the invention and the apparatus 1 according to the invention. It is also possible for layer regions 25 which have been formed by corrosion, oxidation or other forms of degradation to be removed from a component 13 which does not have a coating, these layer regions being in the vicinity of the surface.

Figure 2:
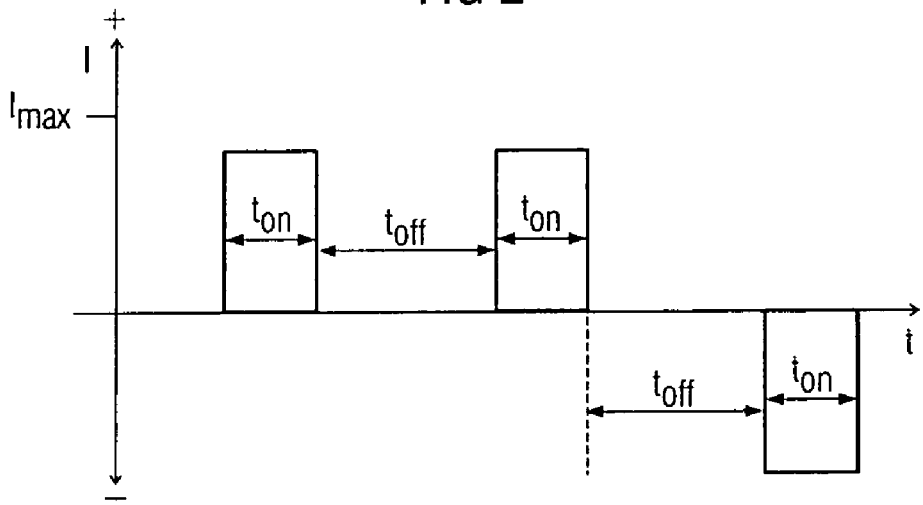
FIG. 2 shows a time curve of a current of a current pulse generator.

The current pulse generator 16 generates a pulsed current/voltage signal (FIG. 2).

An ultrasound probe 19, which is operated by an ultrasound source 22, may optionally be arranged in the electrolyte 7. The ultrasound excitation improves the hydrodynamics of the process and thereby assists the electrochemical reaction.

FIG. 2 shows an example of a current/voltage curve of the current/voltage pulse generator 16.

The current pulse signal or the voltage pulse is, for example, square-wave (pulse shape) and has a pulse duration $t_{on}$. Between the individual pulses there is an interval of length $t_{off}$. Furthermore, the current pulse signal is defined by its current level $I_{max}$.

The current ($I_{max}$) which flows between the electrode 10 and the component 13, the pulse duration ($t_{on}$) and the pulse interval ($t_{off}$) have a significant influence on the electrochemical reaction by accelerating the latter.

Figure 3:
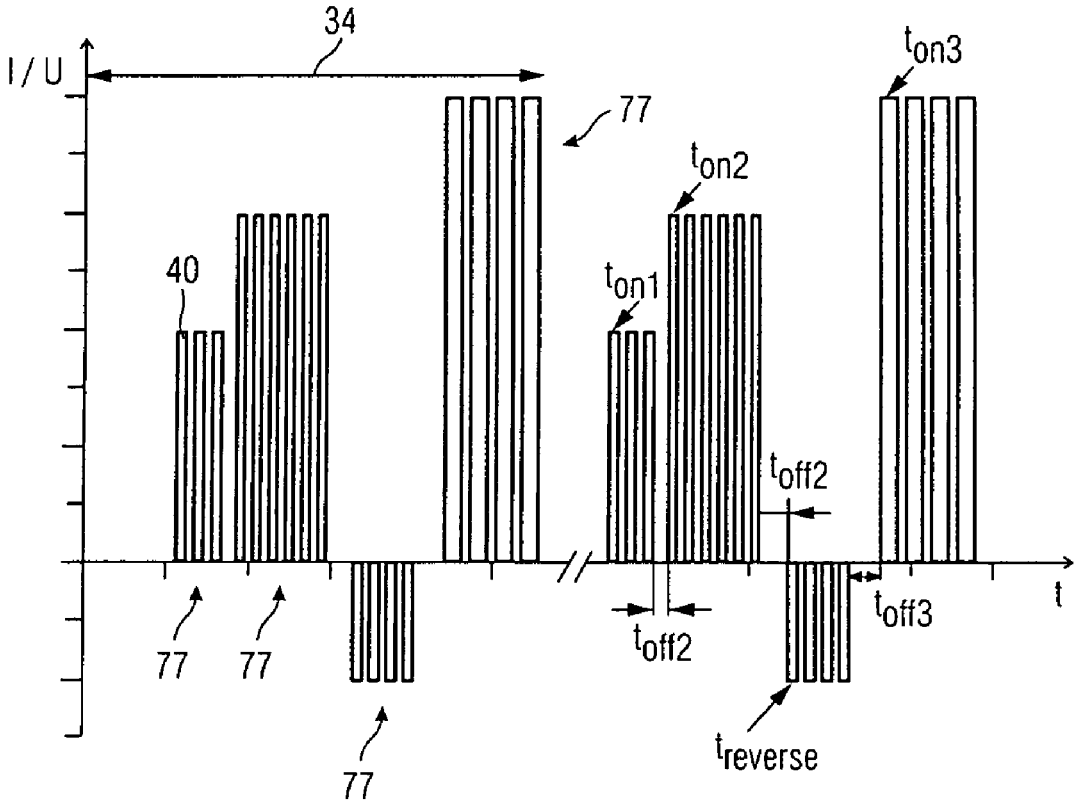
FIG. 3 shows a further time curve of a current from a current pulse generator.

FIG. 3 shows an example of a series of current pulses 40 which are repeated. A sequence 34 comprises at least two blocks 77. Each block 77 comprises at least one current pulse 40. A current pulse 40 is characterized by its duration $t_{on}$, the level $I_{max}$ and its pulse shape (square-wave, delta, etc.). Other important process parameters are the intervals between the individual current pulses 40 ($t_{off}$) and the intervals between the blocks 77.

The sequence 34 comprises, for example, a first block 77 of three current pulses 40 between each of which there is an interval. This is followed by a second block 77, which has a higher current level and comprises six current pulses 40. After a further interval, there then follow four current pulses 40 in the opposite direction, i.e. with a reversed polarity.

The sequence 34 is finished by a further block 77 of four current pulses. The sequence 34 can be repeated a number of times.

The individual pulse times $t_{on}$ are preferably of the order of magnitude of approximately 1 to 10 milliseconds. The time duration of the block 77 is of the order of magnitude of up to 10 seconds, so that up to 500 pulses are emitted in one block 77.

The application of a low potential (base current) both during the pulse sequences and during the intervals is optionally possible.

The parameters of a block 77 are matched to a constituent of an alloy which, by way of example, is to be removed in order to optimize the removal of this constituent. This can be determined in individual tests.

The invention claimed is:

1. A process for removing a coating from a surface region of a component, arranging the component and an electrode in an electrolyte;

electrically connecting the component, the electrode, and a current generator;

generating a pulsed current or pulsed voltage by the current generator;

forming a sequence of current/voltage pulses by a plurality of different blocks with a block having a current pulse;

combining a plurality of current/voltage pulses in sequence during the electrolytic coating removal;

arranging an ultrasound probe within the electrolyte such that ultrasound excitation improves the hydrodynamics of the coating removal process and thereby assists the electrochemical reaction, and wherein a positive and a negative current/voltage pulses are used for the electrolytic coating removal;

wherein a block is defined by a plurality of current pulses, pulse duration, pulse interval, current level, and pulse shape, applying at least a first block which includes at least two consecutives pulses of the same polarity with an interval between the pulses, and applying at least a second block which includes at least two consecutive pulses of the same polarity with an interval between the pulses, wherein the second block is different at least in the current level compared to the first block.

2. The process as claimed in claim 1, wherein a positive or a negative potential is applied to the component to generate a base current or base voltage.

3. The process as claimed in claim 1, wherein a block is matched to a constituent of an alloy to be removed in order to boost the removal of the constituent of the alloy.

4. The process as claimed in claim 1, wherein the coating removed is an of MCrAlY, where M is an element selected from the group consisting of iron, cobalt or nickel.

5. The process as claimed in claim 1, wherein a base current is superimposed on the current pulses and the intervals.

6. The process as claimed in claim 1, wherein a base current is superimposed on the current pulses or the intervals.

7. The process as claimed in claim 1, wherein the current voltage pulse is a square wave shape pulse.

8. The process as claimed in claim 1, wherein the current pulse is a square wave shape pulse.

9. The process as claimed in claim 1, wherein the pulse times range from 1 to 10 milliseconds.

10. The process as claimed in claim 1, wherein a low base current during the pulse sequences and during the intervals is used.

11. The process as claimed in claim 1, wherein the plurality of current/voltage pulses are combined repeatedly.

* * * * *